US011505867B1

(12) United States Patent
Freiderich

(10) Patent No.: US 11,505,867 B1
(45) Date of Patent: Nov. 22, 2022

(54) METHODS AND SYSTEMS FOR ELECTROLESS PLATING A FIRST METAL ONTO A SECOND METAL IN A MOLTEN SALT BATH, AND SURFACE PRETREATMENTS THEREFORE

(71) Applicant: Consolidated Nuclear Security, LLC, Oak Ridge, TN (US)

(72) Inventor: Melissa Ensor Freiderich, Oak Ridge, TN (US)

(73) Assignee: Consolidated Nuclear Security, LLC, Oak Ridge, TN (US)

( * ) Notice: Subject to any disclaimer, the term of this patent is extended or adjusted under 35 U.S.C. 154(b) by 0 days.

(21) Appl. No.: 17/346,504

(22) Filed: Jun. 14, 2021

(51) Int. Cl.

| | |
|---|---|
| ***C23C 18/31*** | (2006.01) |
| ***C23C 18/16*** | (2006.01) |
| ***C25F 3/02*** | (2006.01) |
| ***B05C 3/02*** | (2006.01) |
| ***C25F 7/00*** | (2006.01) |
| ***B05C 3/00*** | (2006.01) |

(52) U.S. Cl.
CPC ..... *C23C 18/31* (2013.01); *B05C 3/005* (2013.01); *B05C 3/02* (2013.01); *C23C 18/1619* (2013.01); *C23C 18/1628* (2013.01); *C23C 18/1637* (2013.01); *C23C 18/1676* (2013.01); *C25F 3/02* (2013.01); *C25F 7/00* (2013.01)

(58) Field of Classification Search
CPC ..... C23C 18/1619; C23C 18/1628; C23C 18/1637; C23C 18/1676
See application file for complete search history.

(56) References Cited

U.S. PATENT DOCUMENTS

| | | | |
|---|---|---|---|
| 3,700,482 | A | 10/1972 | Jacky |
| 3,953,624 | A | 4/1976 | Arnold |
| 3,990,955 | A | 11/1976 | Dill |
| 4,159,926 | A | 7/1979 | Barnes et al. |
| 4,483,711 | A | 11/1984 | Harbulak et al. |
| 5,258,061 | A | 11/1993 | Martyak et al. |
| 5,897,763 | A | 4/1999 | Elligsen et al. |
| 6,156,218 | A | 12/2000 | Okubo et al. |
| 6,800,121 | B2 | 10/2004 | Shahin |
| 8,182,594 | B2 | 5/2012 | Hino et al. |

(Continued)

OTHER PUBLICATIONS

Los Alamos Scientific Laboratory of the University of California, Chemical Surface Treatments for Uranium and Their Application to Uranium Technology, Report written Aug. 8, 1957; Distributed May 13, 1953; pp. 1-20.

(Continued)

*Primary Examiner* — Dah-Wei D. Yuan
*Assistant Examiner* — Stephen A Kitt
(74) *Attorney, Agent, or Firm* — Clements Bernard Walker; Christopher L. Bernard; Christine Wilkes Beninati

(57) ABSTRACT

Systems and methods for electroless plating a first metal onto a second metal in a molten salt bath including: a bath vessel holding a dry salt mixture including a dry salt medium and a dry salt medium of the first metal, and without the reductant therein, the dry salt mixture configured to be heated to form a molten salt bath; and the second metal is configured to be disposed in the molten salt bath and receive a pure coating of the first metal thereon by electroless plating in the molten salt bath, wherein the second metal is more electronegative than the first metal.

16 Claims, 2 Drawing Sheets

(56) References Cited

U.S. PATENT DOCUMENTS

| | | | | |
|---|---|---|---|---|
| 8,292,993 | B2 | 10/2012 | Inagawa | |
| 8,585,811 | B2 | 11/2013 | Nye et al. | |
| 9,175,399 | B2 | 11/2015 | Brunner et al. | |
| 9,399,820 | B2 | 7/2016 | Feis et al. | |
| 9,752,232 | B2 | 9/2017 | Porodo et al. | |
| 9,982,332 | B2 | 5/2018 | Seals | |
| 10,246,778 | B2 | 4/2019 | Janik et al. | |
| 10,358,724 | B2 | 7/2019 | Lee et al. | |
| 10,704,152 | B2 | 7/2020 | Holland et al. | |
| 2016/0308100 | A1* | 10/2016 | Lu | C25D 3/62 |
| 2020/0036011 | A1* | 1/2020 | Numata | C25B 1/04 |

OTHER PUBLICATIONS

Gore et al., Surface Treatments and Electroplated Coatings on Uranium. Plating, Abstract, 1963.

J.R. Lundquist et al., AEC Research and Development Report, Nickel Electroplating on Uranium: Surface Preparation and Plating Solution Studies, Oct. 1965; 45 pages.

J.L. Snelgrove et al., Development and Processing of LEU Targets for Mo Production Overview of the ANL Program, Argonne National Laboratory, Sep. 1995, Argonne, Illinois U.S.A.; 11 pages.

I. Cieszykowska, Electroplating nickel onto uranium as fission-recoil barrier, Institute of Atomic Energy, Nukleonika 2009; 54 (1): 29-32.

K. Turner et al., Thermal-Mechanical Analysis of Varying Boundary Conditions on a LEU Foil based Molybdenum-99 Plate Processing Target, Proceedings of the ASME 2010 International Mechanical Engineering Congress & Exposition, Nov. 12-18, 2010, Vancouver, British Columbia, Canada; pp. 1-7.

J. Lisboa et al., Use of Electrodeposition of Nickel in the Manufacture of Leu Annular Targets, Department of Nuclear Materials, J. Chil. Chem.Soc.,58, No. 4 (2013); pp. 2102-2105.

J. Lisboa et al., Manufacturing of Annular Targets Made of LEU Foil Coated with Electrodeposited Nickel,International Congress of Science and Technology of Metallurgy and Materials, SAM-CONAMET 2013, 2015 Published by Elsevier Ltd; Procedia Materials Science 8 (2015) pp. 434-441.

L.OLivares,Coating of Leu Foil With Electrodeposited Nickel For 99Mo Production, Nuclear Materials Department, Chilean Commission for Nuclear Energy—CCHEN; 10 pages.

F.M. Donahue et al., A Study of the Mechanism of the Electroless Deposition of Nickel, Department of Chemical and Metallurgical Engineering, University of Michigan, Ann Arbor, Michigan 48104, U.S.A; Electrochimica Acta, 1970, vol. 15, pp. 237-239.

N. Feldstein et al., A New Technique for Investigating the Electrochemical Behavior of Electroless Plating Baths and the Mechanism of Electroless Nickel Plating,David Sarnoff Research Center, Journal of The Electrochemical Society, vol. 118, No. 6, 1971, pp. 868-874.

D. Inman et al., The production of refractory of molten salts; design factors metals by the electrolysis and limitations, Journal of Applied Electrochemistry, Department of Metallurgy and Materials Science, Imperial College of Science and Technology, London, 1978, pp. 370-390.

A. Girginov et al., Electrodeposition of refractory metals (Ti, Zr, Nb, Ta) from molten salt electrolytes,Journal of Applied Electrochemistry, 1995, pp. 993-1003.

W. Pitner et al., Electrodeposition of Nickel-Aluminum Alloys from the AluminumChloride-1-methyl-3-ethylimidazolium Chloride Room Temperature Molten Salt, vol. 143, No. 1, Jan. 1996, pp. 129-138.

S. Dahr et al., Electroless Ni plating on n- and p-type porous Si for ohmic and rectifying contacts, Semiconductor Science and Technology, (1996), pp. 1231-1234.

M. Mehmood et al., Electro-Deposition of Tantalum on Tungsten and Nickel in LiF—NaF—CaF2 Melt Containing K2TaF7—Electrochemical Study, Materials Transactions, vol. 44, No. 2 (2003) pp. 259 to 267.

K. Krishnan et al., An Overall Aspect of Electroless Ni—P Depositions—A Review Article, vol. 37A, Jun. 2006, pp. 1917-1926.

R.Orina' Kova' et al., Recent developments in the electrodeposition of nickel and some nickel-based alloys,Journal of Applied Electrochemistry (2006) 36:957-972.

Ishihara et al., Effect of electroless-Ni-plating on corrosion fatigue behavior of magnesium alloy, Surface & Coatings Technology 202 (2008) 2085-2092.

Yuan et al., Characteristics and electrochemical performance of Ni-coated ZnO prepared by an electroless plating process. Applied Surface Science 254 (2008) 5080-5084.

Simka., Electrodeposition of metals from non-aqueous solutions, Electrochimica Acta 54 (2009) pp. 5307-5319.

Duncan, R.N., Electroless Nickel: Past, Present and Future, Palm International, Inc.,Palm International, Inc, LaVergne, Tennessee; undated; 11 pages.

Rao et al., Inkjet printing assisted electroless Ni plating to fabricate nickel coated polypropylene membrane with Improved performance, College of Geography and Environmental Sciences, Zhejiang Normal University, Jinhua 321004, PR China, pp. 546-554, 2020.

Hills et al., Monolayer Formation in the Reduction of Nickel and Silver Ions from the LiCl—KCl Eutectic, Chemistry Department, The University, Southampton, England, vol. 120, No. 2, Feb. 1973, 8 pages.

Li et al., Pretreatment and deposition process of electroless Ni plating on polyimide film for electronic field applications, Colloids and Surfaces A: Physicochemical and Engineering Aspects, Jul. 2015, pp. 42-48.

Vandergrift et al., Modification of Targets and Processes for Conversion of 99Mo Production from High- to Low-Enriched Uranium, Ind. Chem. Res. 2000, 39, 9, 3140-3145, Jun. 29, 2000.

Petit et al.,Electroless Nickel Plating for Corrosion Protection of Uranium, Report No. K-1777, Oct. 13, 1969; 33 pages.

Saliba-Silva et al., Uranium Electrodeposition for Irradiation Targets, © 2013 ECS—The Electrochemical Society, 9 pages.

* cited by examiner

METHODS AND SYSTEMS FOR ELECTROLESS PLATING A FIRST METAL ONTO A SECOND METAL IN A MOLTEN SALT BATH, AND SURFACE PRETREATMENTS THEREFORE

STATEMENT REGARDING FEDERALLY SPONSORED RESEARCH AND/OR DEVELOPMENT

The U.S. Government has certain rights to the present disclosure pursuant to Contract No. DE-NA0001942 between the U.S. Department of Energy and Consolidated Nuclear Security, LLC.

FIELD OF THE DISCLOSURE

The present disclosure relates generally to methods and systems for electroless plating a first metal onto a second metal in a molten salt bath, and surface pretreatments therefore. More specifically, the present disclosure relates to methods and systems for electroless plating a first metal in pure form onto a second metal in a molten salt bath, and surface pretreatments therefore.

BACKGROUND OF THE DISCLOSURE

Coatings, such as Ni coatings, are used as protective barriers for a wide variety of applications in fields such as the automotive, medical and chemical industries, and have been historically plated by electrochemical and electroless techniques. Electrochemical techniques typically use complex equipment and potentially hazardous plating baths, e.g., sulfamate and boric acid baths. Such electrochemical techniques also have difficulty plating complex shapes and creating uniform coatings. Current electroless plating techniques require a reductant, resulting in metal-alloy coatings, such as for example, Ni alloy coatings with P and B contaminants instead of a pure Ni metal coating. Additionally, electroless baths often use complexing agents and stabilizers, further complicating the system.

Thus, what is still needed in the art is a novel approach for electroless plating a first metal in pure form onto a second metal in a molten salt bath without the use of a reductant, and also without the use of complexing agents and stabilizers, and which approach can plate complex shapes with a uniform coating of the pure metal. Further, it is desirable to provide a one-step electroless technique to create pure metal coatings, such as Ni metal coatings, on various substrates. Still further, it is desirable to provide a surface pretreatment for the approach especially when plating a metal prone to oxidation.

BRIEF SUMMARY OF THE DISCLOSURE

In various exemplary embodiments, the present disclosure provides a novel approach for electroless plating a first metal in pure form onto a second metal in a molten salt bath without the use of a reductant, and without the use of complexing agents and stabilizers, and which approach can plate complex shapes with a uniform coating of the pure metal. Further, a one-step electroless technique can be provided to create pure metal coatings, such as Ni metal coatings, on various substrates. Still further, surface pretreatment for the approach can be provided especially when plating a metal prone to oxidation.

In one exemplary embodiment, the present disclosure provides a method for electroless plating a first metal onto a second metal without use of a reductant, the method including: providing a bath vessel holding a dry salt mixture including a dry salt medium and a dry salt medium of the first metal, and without the reductant therein; heating the dry salt mixture to form a molten salt bath; inserting or disposing the second metal in the molten salt bath; and electrolessly plating a pure coating of the first metal onto the second metal in the molten salt bath, wherein the second metal is more electronegative than the first metal. The dry salt medium can include a dry salt medium eutectic, and the dry salt mixture can be heated to melt the eutectic and form the molten salt bath, which is a molten salt eutectic bath. The dry salt medium of the first metal can include any salt having solubility in the eutectic. The dry salt medium of the first metal can include at least one halide salt or ionic salt of the first metal. The dry salt medium can include any metal salt that is soluble in the eutectic. Non-limiting examples include one or more of LiCl, NaCl, KCl, RbCl, CsCl, $MgCl_2$, $CaCl_2$), $SrCl_2$, $BaCl_2$, $ZnCl_2$, $SnCl_4$, $AlCl_3$, $GaCl_3$ and $InCl_3$. The second metal can include at least one of an alkali metal, an alkaline earth metal, a transition metal, a metalloid, a lanthanide, and an actinide. The method can also include, prior to the electroless plating: anionic etching the second metal without use of the reductant to produce an etched second metal, which is disposed in the molten salt bath for the plating thereon. The anionic etching can include: providing a second bath vessel holding a second dry salt medium and without the reductant therein; heating the dry salt medium to form a second molten salt bath; disposing a cathode assembly in the second bath vessel; disposing the second metal in the second molten salt bath as an anode; and coupling a power supply to the anode and the cathode assembly, wherein the power supply produces a current flow that causes etching of the second metal to produce the etched second metal. The second dry salt medium can include a second dry salt medium eutectic, and the second dry salt medium eutectic can be heated to melt the eutectic and form the second molten salt bath, which is a second molten salt eutectic bath.

In another exemplary embodiment, the present disclosure provides a method for anionic etching a second metal without use of a reductant, the method including: providing a bath vessel holding a dry salt mixture, the dry salt mixture including a dry salt medium and without the reductant therein; heating the dry salt mixture to form a molten salt bath; disposing a cathode in the bath vessel; disposing the second metal in the molten salt bath as an anode; and coupling a power supply to the anode and the cathode, wherein the power supply produces a current flow that causes etching of the second metal to produce an etched second metal. The method can further include electroless plating a pure coating of a first metal onto the etched second metal in another molten salt bath including the dry salt medium and a dry salt medium of the first metal, and without a reductant therein, wherein the second metal is more electronegative than the first metal. The dry salt medium can include a dry salt medium eutectic, and the dry salt medium eutectic and the dry salt medium of the first metal can be heated to melt the eutectic and form a molten salt eutectic bath for the electroless plating.

In a further exemplary embodiment, the present disclosure provides a bath system for electroless plating a first metal onto a second metal without use of a reductant and/or for anionic etching the second metal without use of the reductant, the system including: a bath vessel holding a dry salt mixture including a dry salt medium and without the reductant therein, the dry salt mixture can be configured to be heated to form a molten salt bath; and the second metal can be configured to be disposed in the molten salt bath for the electroless plating of the first metal onto the second metal and/or for the anionic etching of the second metal, wherein the second metal is more electronegative than the first metal. The dry salt mixture can include the dry salt medium and a dry salt medium of the first metal, and wherein the second metal can be configured to be disposed in the molten salt bath and receive a pure coating of the first metal thereon by the electroless plating in the molten salt bath. The dry salt medium can include a dry salt medium eutectic, and the dry salt medium eutectic can be configured to be heated to melt the eutectic and form the molten salt bath, which is a molten salt eutectic bath. The dry salt medium of the first metal can include any salt having a solubility in the eutectic. The dry salt medium of the first metal can include at least one halide salt or ionic salt of the first metal. The dry salt medium can include any metal salt that is soluble in the eutectic. Non-limiting examples include one or more of LiCl, NaCl, KCl, RbCl, CsCl, $MgCl_2$, $CaCl_2$, $SrCl_2$, $BaCl_2$, $ZnCl_2$, $SnCl_4$, $AlCl_3$, $GaCl_3$ and $InCl_3$. The second metal can include at least one of an alkali metal, an alkaline earth metal, a transition metal, a metalloid, a lanthanide, and an actinide. The system can further include: a cathode disposed in the bath vessel; the second metal can be configured to be disposed in the molten salt bath as an anode; and a power supply coupling the anode and the cathode, wherein the power supply can be configured to produce a current flow that causes etching of the second metal.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION

Figure 1:
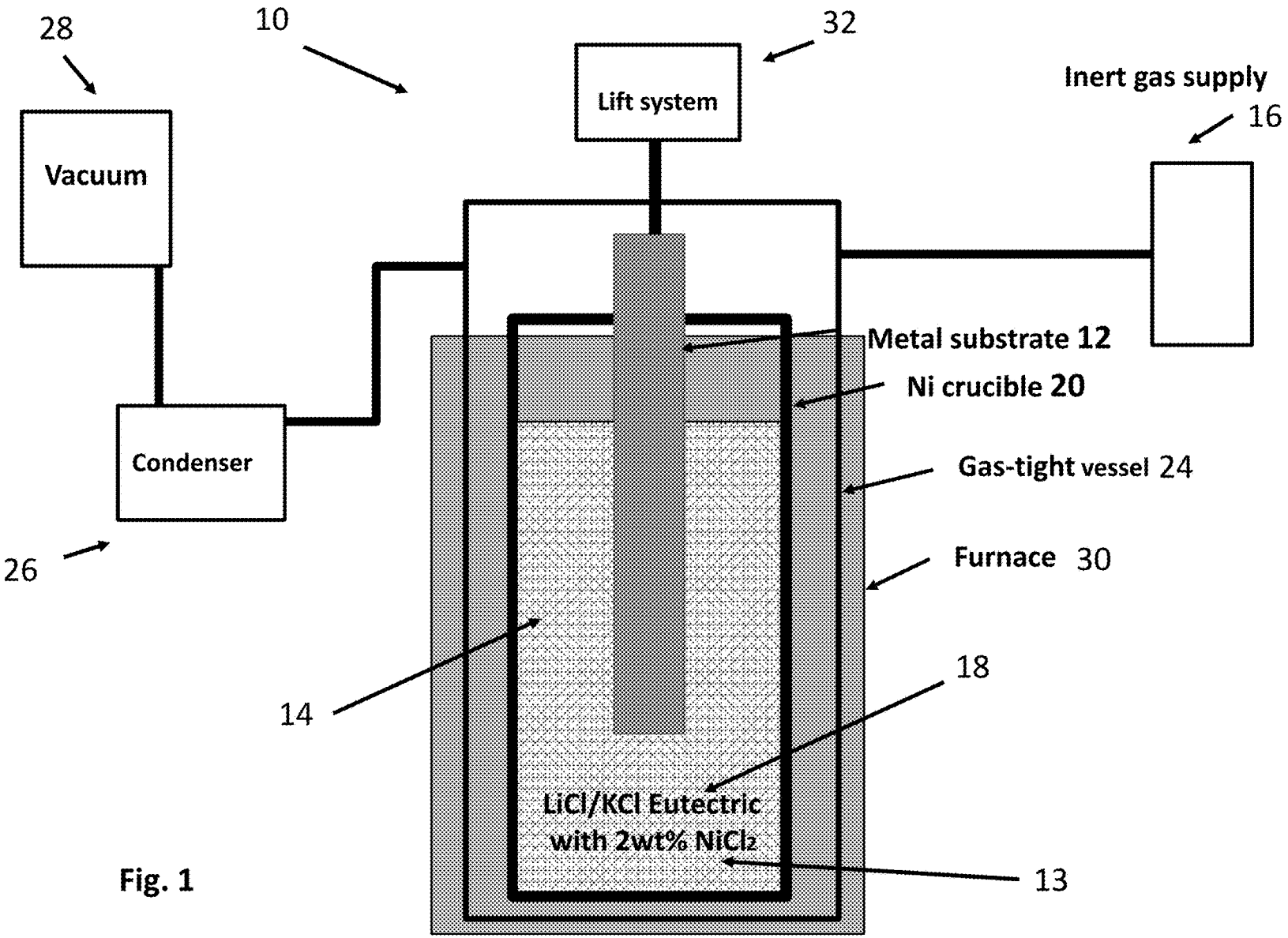
FIG. 1 is schematic diagram illustrating one exemplary embodiment of the system/method for electroless plating a first metal onto a second metal in a molten eutectic bath, of the present disclosure.

Referring now specifically to FIG. 1, in one exemplary embodiment, the present disclosure provides a system/method 10 for electroless plating a first metal in pure form onto a second metal 12 in a molten salt eutectic bath 14 without the use of a reductant, and without the use of complexing agents and stabilizers, and which approach can plate complex shapes with a uniform coating of the pure metal/first metal. The inventor has thus advantageously developed a method and system 10 for the electroless plating of a uniform deposit of a pure metal/first metal onto a second metal 12 without requiring reduction, and thereby avoiding unwanted side reactions and contaminants such as P and B in the deposited coating.

Second metal 12 shown in FIG. 1 is the substrate or product of desired metal onto which a uniform coating of a pure metal/first metal is deposited onto. Second metal 12 can be of any shape and size, such as a cylindrical rod, tube, etc. Second metal 12 may also be of any desired metal such as, e.g., Al, Li, Ti, Zr, U and so forth. The first metal and second metal 12 are advantageously selected such that the second metal 12 is more electronegative than the first metal. It is further noted that potential values can change with concentration adjustment of the materials.

As further shown in FIG. 1, under an inert atmosphere provided by an inert gas supply 16, a dry salt medium eutectic 18 is placed inside bath vessel 20 along with a dry salt medium 13 of the first metal. Bath vessel 20 is shown in FIG. 1 as a Ni crucible, however, other suitable crucibles or holding apparatuses can be employed. The bath vessel 20 is positioned within a gas-tight vessel 24, which receives the flow of inert gas, such as nitrogen or argon, from inert gas supply 16 and circulates through the system 10 with the use of condenser 26 and vacuum 28. Thus, the processing can be conducted in a "glove box." It is further noted that the referenced use of inert gas from inert gas supply 16, condenser 26 and vacuum 28 may only be needed for easily oxidized metals. It is further noted that a main function of the constituents of the system is to keep moisture and oxygen levels low, e.g., about <5 ppm, according to embodiments.

In the exemplary and non-limiting embodiment of FIG. 1 illustrated for depositing pure Ni as the first metal on metal substrate 12, for the dry salt medium eutectic 18 dry LiCl and KCl are employed and weighed (in 100 g; 45 g LiCl and 55 g KCl), and then placed into a 99% cylindrical Ni crucible 20 along with dry $NiCl_2$ (e.g., about 2-3% by weight) for the dry salt medium 13 of the first metal. Thus, it will be appreciated that other suitable salts, combinations and amounts could be employed. For example, instead of LiCl/KCl for the dry salt medium eutectic 18, other suitable eutectics may be employed such as KCl/NaCl, NaCl/LiCl, etc. Similarly, nitrate salts also form eutectics (NaNO3/KNO3), as well as fluoride salts (KF/NaF). It will also be appreciated that the amount can vary depending upon what material is being plated. For example, the concentration of Ni in the molten salt can change the potential, so depending on the metal to be plated, the value may be adjusted up or down to ensure that the Ni is less electronegative, according to embodiments.

Similarly, instead of dry $NiCl_2$ (e.g., about 2-3% by weight) for the dry salt medium 13 of the first metal, other suitable constituents can be employed and in varying amounts such at between about 1 to 10% by weight, as a non-limiting example. For example, other salt combinations, e.g., ionic salts, fluoride salts, etc., can be employed and especially any metal salt that has solubility in a eutectic and a more electronegative metal substrate 12. As a further non-limiting example, AgCl (silver chloride) can be electrolessly plated on a Ni substrate 12, according to embodiments.

Thus, the dry salt medium eutectic 18 and the dry salt medium 13 of the first metal form a salt mixture in the crucible 20, which is then placed in the furnace 30, as shown in FIG. 1, under dry, oxygen-free conditions and heated to about 450° C. to create a molten salt eutectic bath 14 suitable for plating the metal substrate 12. It is noted that the eutectic melts at about 415° C. to about 425° C. so the heating temperature could also be increased to a higher temperature, but it would typically not be desirable or possible to be lower than the eutectic melting temperature. The metal substrate 12 to be plated can then be slowly lowered using lift system 32, or any other suitable transport/lifting system or mechanism, and maintained in the molten salt eutectic bath 14 or melt for the desired time. In this regard, it is noted that the thickness of the plating is directly related to the length of time in the plating bath (i.e., molten salt eutectic bath 14 or melt) and can vary depending upon the desired thickness of resultant coating. As a non-limiting example, about 3 to 5 minutes in bath 14 can result in a coating of about 8 to 10 microns on metal substrate 12. Once sufficient time has passed, the metal substrate 12 with the resultant coating of pure metal/first metal thereon can be lifted up out of the bath 14 using lift system 32 or other suitable transport/lifting system or mechanism, and allowed to cool for a desired time. Some of the salt may adhere to the surface of metal substrate 12, but this can easily be removed after solidifying with gentle pressure and brushing.

In the non-limiting example of FIG. 1 for the deposition of Ni as the first metal, it is noted that the electrochemical reaction of Ni is: $Ni^{2+}+2e^{-} \Leftrightarrow Ni^{0} E=-0.23$ V. The electrons for this reaction are provided by the metal substrate 12; thus, this reaction will only proceed if the metal substrate 12 has a redox potential more negative than Ni. These metals include, e.g., Zr, U, Cd, Fe, Cr, Zn, Mn, Al and Li. In addition, and as noted above, other salt combinations could be used to create the eutectic, e.g., other chloride salts and fluoride salts.

Figure 2:
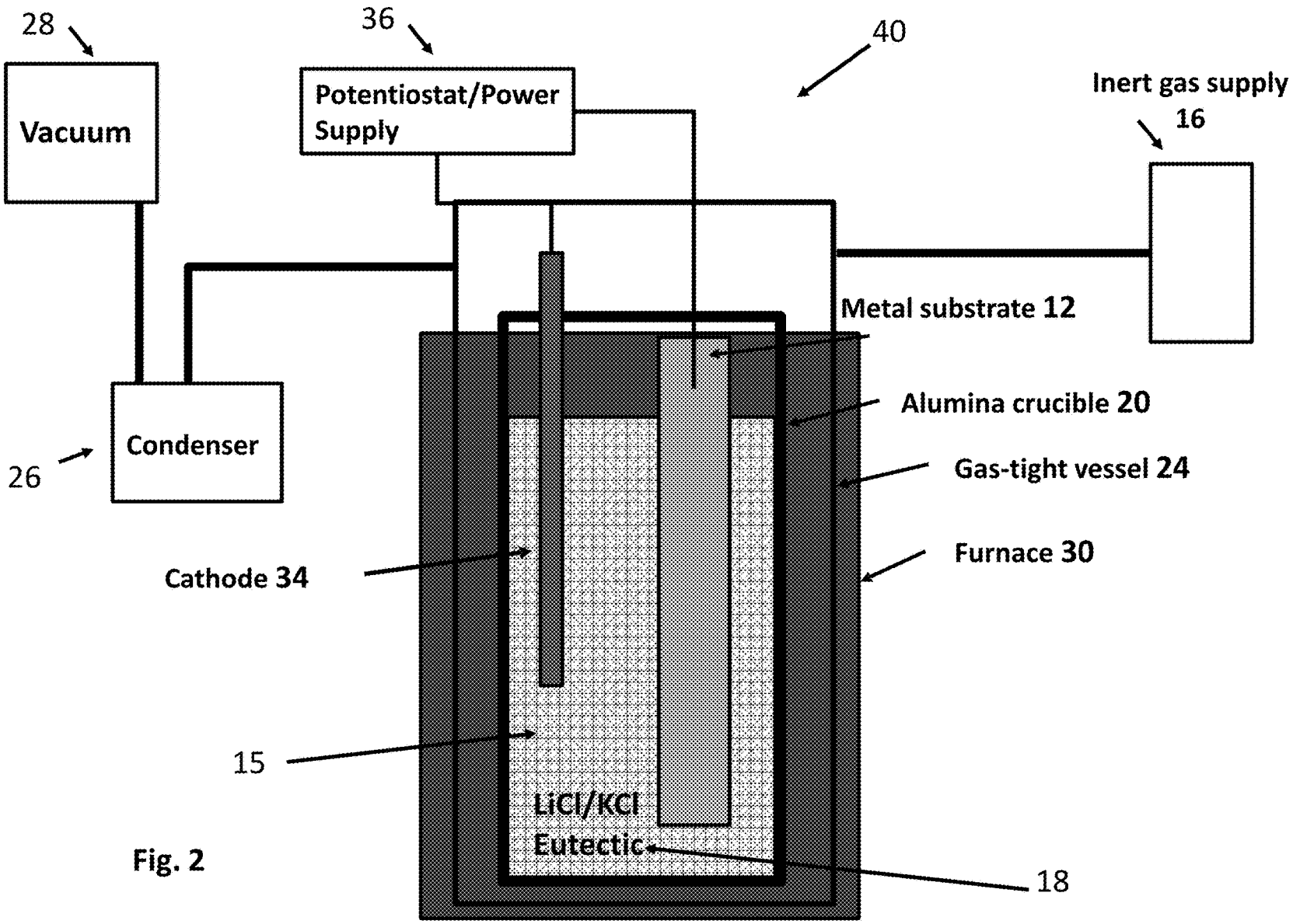
FIG. 2 is a schematic diagram illustrating one exemplary embodiment of a system/method for surface pretreatment of the first metal of FIG. 1 prior to electroless plating, of the present disclosure.

Referring now to FIG. 2, FIG. 2 is a schematic diagram illustrating one exemplary embodiment of a system/method 40 for surface pretreatment of the second metal 12 of FIG. 1 prior to electroless plating thereof, of the present disclosure. Such pretreatment is particularly useful prior to plating to further ensure that the plating can adhere to the surface of the second metal 12. However, it is noted that while the surface pretreatment of FIG. 2 is primarily described herein with respect to use prior to the electroless plating described in FIG. 1, such pretreatment while advantageous is not required. The surface pretreatment described with respect to FIG. 2 can be employed as a stand-alone system/method 40 and is advantageous to pretreat any surface, particularly those metal surfaces such as, e.g., Zr and U, that rapidly oxide in air and/or have an oxide layer typically resistant to removal.

Referring now specifically to FIG. 2, in one exemplary embodiment, the present disclosure provides a system/method 40 for pretreating or anodic etching a metal substrate, such as second metal 12, in a molten salt eutectic bath 15 without the use of a reductant, and without the use of complexing agents and stabilizers. The metal substrate may be any desired metallic substrate. As noted above, the system/method 40 of FIG. 2 is particularly useful for pretreating second metal 12, which is the substrate or product of desired metal onto which a uniform coating of a pure metal/first metal is desired to be deposited onto, however, the present invention is not limited to such applications.

Second metal 12 can be of any shape and size, such as a cylindrical rod, tube, etc. Second metal 12 may also be of any desired metal such as, e.g., Al, Li, Ti, Zr, U and so forth. If the method/system 40 is to be employed prior to the method/system of FIG. 1, the first metal and second metal 12 are advantageously selected such that the second metal 12 is more electronegative than the first metal. It is also noted that potential values can change with concentration adjustment of the materials.

As further shown in FIG. 2 and similarly in FIG. 1, under an inert atmosphere provided by an inert gas supply 16, a dry salt medium eutectic 18 is placed inside bath vessel 20. In this case and in contrast to FIG. 1, dry salt medium 13 of the first metal is not present in the bath vessel 20. Bath vessel 20 is shown in FIG. 2 as an alumina crucible, however, other suitable crucibles or holding apparatuses can be employed, especially other ceramic crucibles. The bath vessel 20 is positioned within a gas-tight vessel 24, which receives the flow of inert gas, such as nitrogen or argon, from inert gas supply 16 and circulates through the system 40 with the use of condenser 26 and vacuum 28. Thus, the processing can be conducted in a "glove box." It is further noted that the referenced use of inert gas from inert gas supply 16, condenser 26 and vacuum 28 may only be needed for easily oxidized metals. It is further noted that a main function of constituents of the system is operation to keep moisture and oxygen levels low, e.g., about <5 ppm, according to embodiments.

In the exemplary and non-limiting embodiment of FIG. 2, for the dry salt medium eutectic 18 dry LiCl and KCl are employed and weighed (in 100 g; 45 g LiCl and 55 g KCl), and then placed into the crucible 20. It will be appreciated that other suitable salts, combinations and amounts could be employed. For example, instead of LiCl/KCl for the dry salt medium eutectic 18, other suitable eutectics may be employed such as KCl/NaCl, NaCl/LiCl, etc. Similarly, nitrate salts also form eutectics (NaNO3/KNO3), as well as fluoride salts (KF/NaF). As noted above and if plating is subsequently employed according to embodiments, it will be appreciated that the amount can vary depending upon what material is being plated. For example, the concentration of Ni in the molten salt can change the potential, so depending on the metal to be plated, the value may be adjusted up or down to ensure that the Ni is less electronegative, according to embodiments. It will be appreciated that the ratio of the salts can affect formation of the eutectic as changing the ratio can change the temperature at which the salts melt.

Thus, the dry salt medium eutectic 18 is then placed in furnace 30, as shown in FIG. 2, under dry, oxygen free conditions and heated to about 450° C. to create molten salt eutectic bath 15 suitable for pretreating or anionic etching the metal substrate 12. It is noted that the eutectic melts at about 415° C. to about 425° C. so the heating temperature could also be increased to a higher temperature, but it would typically not be desirable to be much lower than the eutectic melting temperature. The metal substrate 12 to be pretreated or etched can be slowly lowered using lift system 32, or any other suitable transport/lifting system or mechanism, to be maintained in the molten salt eutectic bath 15 or melt for the desired time. An electrochemical cell may be employed in the method/system 40, and the method/system 40 can comprise an anode and a cathode 34. As shown in FIG. 2, a metal rod such as, e.g., stainless steel, Ni, Pt, Ag, can be employed as the cathode 34, although other suitable materials, shapes and sizes are possible. For example, graphite, Mo or W could also be employed. Similarly, the metal substrate 12 for pretreatment/etching can be employed as the anode in the system/method 40. Alligator clips can be used to connect the cathode 34 and the anode to a power supply 36. It is noted that the electrodes should not touch. After allowing the electrodes to equilibrate in the molten salt eutectic bath 15, a current or potential is applied to remove oxides from the metal substrate 12 and plate the metal on the cathode (metal rod shown in FIG. 2). Only about a minute or a few minutes, such as about 1 to 5 minutes, under varying desired currents such as, e.g., about 0.2 to 1 Amp, are generally needed to complete the etching of the metal substrate 12 as such lower amperage may result in better plating. Etching time is controlled and can vary depending upon the metal substrate 12 employed. Etching can be controlled such that the metal surface 12 is minimally changed and chunks of the metal are not removed. Accordingly, a sufficient potential may be applied that can strip any oxide layer from the metal substrate 12 under the inert atmosphere so it will not oxidize as soon as taken out of the molten salt eutectic bath 15.

Thus, after the etching is complete, the metal substrate 12, now etched, can be removed from the molten salt eutectic bath 15 using the lift system 32, or any other suitable transport/lifting system or mechanism, and thereafter submerged, typically immediately, in the molten salt eutectic bath 14 or melt of FIG. 1 and proceed accordingly, as described above, according to embodiments.

Alternatively, the metal substrate 12, which is now sufficiently pretreated and etched can be removed from the molten salt eutectic bath 15 of FIG. 2 and used as desired, including use in other systems/methods depending upon desired application. Thus, it is not required for the metal substrate 12, now sufficiently etched, to be employed in the plating system/method 10 of FIG. 1 and FIG. 2 can represent a stand-alone system/method with other applications.

Advantages of embodiments of the invention include the ability to provide uniform, pure coatings on various, complex shaped substrates including tubular and cylindrical shapes, without including contaminants therein such as P and B. Pure may herein refer to a metal not alloyed with other metallic elements and/or may be at least 99% purity of the metal. Embodiments are especially usefully for providing pure coatings, especially pure Ni coatings, on metal substrates, which can be used as decorative and protective barriers (e.g., corrosion protection layers) in various industries such as the automotive, medical and chemical industries. Such coatings can provide resistance to dry gases, soaps, $CCl_4$ and the like.

Embodiments of the invention also provide advantages over prior metal plating methods, especially prior Ni plating methods. For instance, prior electroless deposition and plating methods include an aqueous bath requiring a reductant. In contrast, according to embodiments, electroless plating without a reductant is disclosed using a molten salt bath as opposed to an aqueous media and thus provides for the removal of complex, unwanted side reactions that occur in aqueous media.

Still further advantages of embodiments of the invention include minimal equipment required, fast processing and no hazardous solvents required.

Moreover, the herein described surface pretreatment or etching method/system according to embodiments can provide the desired etching with minimal change of substrate surface. Thus, embodiments can provide a two-step process for surface preparation and plating of pure coatings on various substrates, e.g., pure Ni coating on U substrates, with minimal equipment and without numerous processing steps.

Thus, embodiments of the invention can provide advantageous over prior methods and systems including, e.g., i) electroless deposition of metal, such as Ni, without a reductant, providing a pure metal coating without P or B contaminants; ii) an improved plating bath, e.g., LiCl/KCl/$NiCl_2$ versus Watts bath (nickel sulfate/sulfamate, nickel chloride, boric acid, water); iii) a non-aqueous system so no pH concerns; iv) limited materials and equipment needed, thus scalable with no size limitations as opposed to PVD processing; iv) molten salt anodic etching of various substrates, such as U, Zr, Ni, etc., without hazardous chemical (e.g., concentrated acids); and v) single-step preparation versus multi-step, lengthy processes.

Thus, it can be seen that embodiments of the invention offer advantages over prior metal coating techniques, e.g., prior Ni coating techniques such as Ni electroplating, Ni electroless plating in an aqueous media and PVD processing. For example, Ni electroplating typically employs a Watts bath including $NiSO_4$, $NiCl_2$ and $H_3BO_3$ with a pH of 4.7 to 5.1, and cleaning of the substrate surface.

Electroless plating, such as Ni electroless plating, in an aqueous media uses a reductant, complexing agent and other stabilizers in the aqueous media and the resultant Ni coating contains P or B contaminants. Thus, in an electroless aqueous system, a reductant is required to move the electrons. In contrast, according to embodiments, reduction is not employed or required as a significant advantage is using a molten salt bath, avoiding unwanted side reactions. For example, according to embodiments a Ni salt may be added into the molten salt bath and the Ni will plate onto a substrate that is more electronegative that the Ni resulting in a pure, uniform deposit of Ni coating as opposed to other electroless techniques resulting in P or B contaminants in the coating.

In further contrast to embodiments of the invention, PVD processing includes vacuum deposition and sputtering and has complex equipment and cooling requirements, as well as size and shape limitations/constraints.

Thus embodiments can employ a single step to create a pure metal coating (e.g., Ni) in a molten salt bath without potentially hazardous chemicals and electrolessly plate the pure metal coating uniformly.

It is further noted that alternative embodiments may include the use of ionic liquids and other salts, instead of salt eutectics and/or use of electroplating in the molten salt. For example, the molten salt mediums of FIGS. 1 and 2 could be any conductive fluid, such as an ionic liquid (e.g., 1-butyl-3-methylimidazolium chloride), according to some embodiments. Thus, according to embodiments, ionic liquids may be employed instead of molten salts to run the herein describes processes at room temperature.

Although the present disclosure is illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following non-limiting claims for all purposes. Additional all disclosed features and elements can be used in any combinations, according to embodiments.

What is claimed is:

1. A method for electroless plating a first metal onto a second metal without use of a reductant, the method comprising:

providing a bath vessel holding a dry salt mixture comprising a dry salt medium and a dry salt medium of the first metal, and without the reductant therein;

heating the dry salt mixture to form a molten salt bath;

disposing the second metal in the molten salt bath; and electrolessly plating a pure coating of the first metal onto the second metal in the molten salt bath, wherein the second metal is more electronegative than the first metal, wherein the dry salt mixture comprises the dry salt medium and the dry salt medium of the first metal which is Ni, and wherein the second metal is disposed in the molten salt bath and receives a pure, uniform coating of the Ni first metal thereon in a single step by the electroless plating in the molten salt bath.

2. The method of claim 1, wherein the dry salt medium comprises a dry salt medium eutectic, and the dry salt mixture is heated to melt the eutectic and form the molten salt bath, which is a molten salt eutectic bath.

3. The method of claim 2, wherein the dry salt medium of the first metal comprises any salt having solubility in the eutectic.

4. The method of claim 1, wherein the dry salt medium of the first metal comprises at least one halide salt or ionic salt of the first metal.

5. The method of claim 1, wherein the dry salt medium comprises one or more of LiCl, NaCl, KCl, RbCl, CsCl, $MgCl_2$, $CaCl_2$, $SrCl_2$, $BaCl_2$, $ZnCl_2$, $SnCl_4$, $AlCl_3$, $GaCl_3$ and $InCl_3$.

6. The method of claim 1, wherein the second metal comprises at least one of an alkali metal, an alkaline earth metal, a transition metal, a metalloid, a lanthanide, and an actinide.

7. The method of claim 1 further comprising, prior to the electroless plating:

anionic etching the second metal without use of the reductant to produce an etched second metal, which is disposed in the molten salt bath for the plating thereon.

8. The method of claim 7, wherein the anionic etching comprises:

providing a second bath vessel holding a second dry salt medium and without the reductant therein;

heating the dry salt medium to form a second molten salt bath;

disposing a cathode in the second bath vessel;

disposing the second metal in the second molten salt bath as an anode; and coupling a power supply to the anode and the cathode, wherein the power supply produces a current flow that causes etching of the second metal to produce the etched second metal.

9. The method of claim 8, wherein the second dry salt medium comprises a second dry salt medium eutectic, and the second dry salt medium eutectic is heated to melt the eutectic and form the second molten salt bath, which is a second molten salt eutectic bath.

10. A bath system for electroless plating a first metal, onto a second metal without use of a reductant and/or for anionic etching the second metal without use of the reductant, the system comprising:

a bath vessel holding a dry salt mixture comprising a dry salt medium and without the reductant therein, the dry salt mixture configured to be heated to form a molten salt bath; and the second metal is configured to be disposed in the molten salt bath for the electroless plating of the first metal onto the second metal and/or for the anionic etching of the second metal, wherein the second metal is more electronegative than the first metal;

wherein the dry salt mixture comprises the dry salt medium and a dry salt medium of the first metal which is Ni, and wherein the second metal is configured to be disposed in the molten salt bath and receive a pure, uniform coating of the Ni first metal thereon in a single step by the electroless plating in the molten salt bath.

11. The bath system of claim 10, wherein the dry salt medium comprises a dry salt medium eutectic, and the dry salt medium eutectic is configured to be heated to melt the eutectic and form the molten salt bath, which is a molten salt eutectic bath.

12. The bath system of claim 11, wherein the dry salt medium of the first metal comprises any salt having a solubility in the eutectic.

13. The bath system of claim 10, wherein the dry salt medium of the first metal comprises at least one halide salt or ionic salt of the first metal.

14. The bath system of claim 10, wherein the dry salt medium comprises one or more of LiCl, NaCl, KCl, RbCl, CsCl, $MgCl_2$, $CaCl_2$, $SrCl_2$, $BaCl_2$, $ZnCl_2$, $SnCl_4$, $AlCl_3$, $GaCl_3$ and $InCl_3$.

15. The bath system of claim 10, wherein the second metal comprises at least one of an alkali metal, an alkaline earth metal, a transition metal, a metalloid, a lanthanide, and an actinide.

16. The bath system of claim 10 further comprising:

a cathode disposed in the bath vessel;

the second metal configured to be disposed in the molten salt bath as an anode; and a power supply coupling the anode and the cathode, wherein the power supply is configured to produce a current flow that causes etching of the second metal.

* * * * *